US009126428B2

(12) United States Patent
Oba et al.

(10) Patent No.: US 9,126,428 B2
(45) Date of Patent: Sep. 8, 2015

(54) MARK DETECTION METHOD AND PRINT APPARATUS

(71) Applicant: SEIKO EPSON CORPORATION, Tokyo (JP)

(72) Inventors: Masashi Oba, Nagano (JP); Daiki Tokushima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/536,086

(22) Filed: Nov. 7, 2014

(65) Prior Publication Data

US 2015/0174927 A1 Jun. 25, 2015

(51) Int. Cl.
*B41J 11/00* (2006.01)
*B41J 13/00* (2006.01)

(52) U.S. Cl.
CPC ..... *B41J 13/0009* (2013.01)

(58) Field of Classification Search
CPC .. B41J 11/0095; B41J 13/0027; B41J 13/103; B41J 3/46; B41J 3/60; B41J 11/46
USPC ..... 347/14, 16, 19, 101, 104–106
See application file for complete search history.

(56) References Cited

U.S. PATENT DOCUMENTS

| | | | | |
|---|---|---|---|---|
| 7,552,995 | B2 * | 6/2009 | Nakazawa et al. | 347/40 |
| 7,959,248 | B2 * | 6/2011 | Naoi et al. | 347/16 |
| 2013/0155131 | A1 | 6/2013 | Izawa et al. | |

FOREIGN PATENT DOCUMENTS

| | | | |
|---|---|---|---|
| JP | 2006-076169 | A | 3/2006 |
| JP | 2009-018437 | A | 1/2009 |
| JP | 2013-123832 | A | 6/2013 |

* cited by examiner

*Primary Examiner* — Thinh Nguyen
(74) *Attorney, Agent, or Firm* — Global IP Counselors, LLP

(57) ABSTRACT

A mark detection method includes a first step for acquiring a signal that is outputted from a detector configured to output a signal of a first level when a detection value is equal to or more than a first threshold value and output a signal of a second level different from the first level when the detection value is less than the first threshold value, while a state of a web is being detected using the detector, a second step for acquiring conveyance information indicative of a state of conveyance of the web, and a third step for determining whether or not to count the signal of the second level outputted by the detector based on the conveyance information.

8 Claims, 6 Drawing Sheets

MARK DETECTION METHOD AND PRINT APPARATUS

CROSS-REFERENCE TO RELATED APPLICATIONS

This application claims priority to Japanese Patent Application No. 2013-263483 filed on Dec. 20, 2013. The entire disclosure of Japanese Patent Application No. 2013-263483 is hereby incorporated herein by reference.

BACKGROUND

1. Technical Field

The present invention relates to a technique for detecting a mark provided to a web.

2. Related Art

Japanese laid-open patent publication No. 2006-76169 discloses a print apparatus with which a mark formed on a surface of a web is detected by a detecting means. In particular, a configuration for detecting fouling or abnormality in the detecting means in advance is provided, in order to address a problem where a mark is erroneously detected due to fouling or abnormality in the detecting means.

However, the erroneous detection of a mark can also take place due to causes other than fouling, abnormality, or the like of a detector (detecting means). In one example, when foreign matter adheres to the web, then the foreign matter passes through the front of the detector and alters an output signal of the detector. As a result, there is the risk that this foreign matter could be erroneously detected as a mark. Alternatively, in a case where the web is stopped in a state where a mark is located in the vicinity of the detector, then when the web vibrates due to being pushed by a gusting air flow or the like, the mark sways in front of the detector and alters the output signal of the detector. As a result, there is the risk that the mark could end up being erroneously detected.

SUMMARY

The present invention has been made in view of the above problems, and an objective thereof is to provide a technique that contributes to an improvement of the accuracy of detecting a mark provided to a web.

In order to achieve the above-described objective, a mark detection method as in one aspect of the present invention comprises acquiring a signal that is outputted from a detector while a state of a web is being detected using the detector, the detector being configured to output a signal of a first level when a detection value is equal to or more than a first threshold value and output a signal of a second level different from the first level when the detection value is less than the first threshold value; acquiring conveyance information indicative of a state of conveyance of the web; and determining whether or not to count the signal of the second level outputted by the detector, based on the conveyance information.

In order to achieve the above-described objective, a print apparatus as in the invention comprises a detector configured to output a signal of a first level when a detection value is equal to or more than a first threshold value and output a signal of a second level different from the first level when the detection value is less than the first threshold value; and a control unit configured to cause the detector to detect a state of a web, acquire a signal outputted from the detector, acquire conveyance information that is indicative of a state of conveyance of the web, and determine, based on the conveyance information, whether or not to count the signal of the second level outputted by the detector.

With the invention (mark detection method, print apparatus) thus configured, the state of the web is detected using the detector. This detector outputs a signal of a first level when a detection value is not less than a first threshold value but outputs a signal of a second level different from the first level when the detection value is less than the first threshold value. When this detector is used, the mark can be detected on the basis of a signal of the second level. The signal of the second level, however, could be outputted not only when the mark is detected correctly, but also when foreign matter or vibration of the web occurs, as stated above. As such, in order to improve the accuracy of detection of the mark, the question of whether or not to count a signal of the second level outputted by the detector needs to be determined. For this, in the invention, the conveyance information indicative of the state of conveyance of the web is acquired. Then, on the basis of this conveyance information, a decision is made as to whether or not to count a signal of the second level outputted by the detector. The invention is able to curb the impact caused by foreign matter or vibration of the web, and contributes to improving the accuracy of detecting the mark.

The mark detection method may be configured so that the determining includes determining whether or not to count the signal of the second level outputted by the detector on the basis of a result from when a conveyance amount of the web in a period during which the detector continuously outputs the signal of the second level is found from the conveyance information. Namely, in, for example, a case such as where the conveyance amount of the web in the period during which the signal of the second level is continuously outputted is significantly different from the width of the mark, then this signal of the second level can be generally determined to be due to something other than the mark, i.e., foreign matter or vibration of the web/ In this manner, deciding whether or not to count the signal of the second level on the basis of the conveyance amount of the web makes it possible to improve the accuracy of detection of the marks.

More specifically, the mark detection method may be configured so that the determining includes determining not to count the signal of the second level outputted by the detector in a case where the conveyance amount of the web in a period during which the detector continuously outputted the signal of the second level is less than a second threshold value. With such a configuration, comparing the conveyance amount of the web and the second threshold value makes it possible to easily decide whether or not to count the signal of the second level.

Alternatively, the mark detection method may be configured so that the determining includes determining whether or not to count the signal of the second level outputted by the detector based on a result from when the conveyance amount of the web in the period during which the detector continuously outputs a signal of the first level until when the detector starts outputting the signal of the second level is evaluated from the conveyance information. With this configuration, the determination is executed on the basis of the conveyance amount of the web in the period during which the detector continuously outputs a signal of the first level until when the detector starts outputting the signal of the second level. In other words, the period during which the signal of the first level persists corresponds to a period from after the previous signal of the second level is outputted until when the subject signal of the second level is outputted, and corresponds to the interval between signals of the second level. As such, in, for example, a case such as where the conveyance amount of the web in a period during which a signal of the first level persists is significantly different from the interval between adjacent marks, then the subject signal of the second level can be generally determined to be due to something other than the mark, i.e., foreign matter or vibration of the web. In this manner, deciding whether or not to count the signal of the second level on the basis of the conveyance amount of the web makes it possible to improve the accuracy of detection of the marks.

More specifically, the mark detection method may be configured so that the determining includes determining not to count the signal of the second level that the detector has started outputting in a case where the conveyance amount of the web in the period during which the detector has continuously outputted a signal of the first level is less than a third threshold value. With such a configuration, comparing the conveyance amount of the web and the third threshold value makes it possible to easily decide whether or not to count the signal of the second level.

The mark detection method may also be configured so as to further comprise counting the number of signals of the second level for which counting has been decided, in the determining. With this configuration, the counting is executed every time the mark is detected by the detector in association with the conveyance of the web. As such, the conveyance amount, meaning the conveyance position, of the web can be ascertained from the count value.

The mark detection method may also be configured so that counting of the number of signals of the second level includes incrementing a count value with which the number of signals of the second level is counted in a case where a direction of conveyance of the web as indicated by the conveyance information is a first direction, and decrementing the count value in a case where the direction of conveyance of the web as indicated by the conveyance information is a second direction opposite to the first direction. With this configuration, the count value is increased or decreased depending on the direction of conveyance of the web, and therefore the count value can be made to be accurately reflective of the conveyance position of the web.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
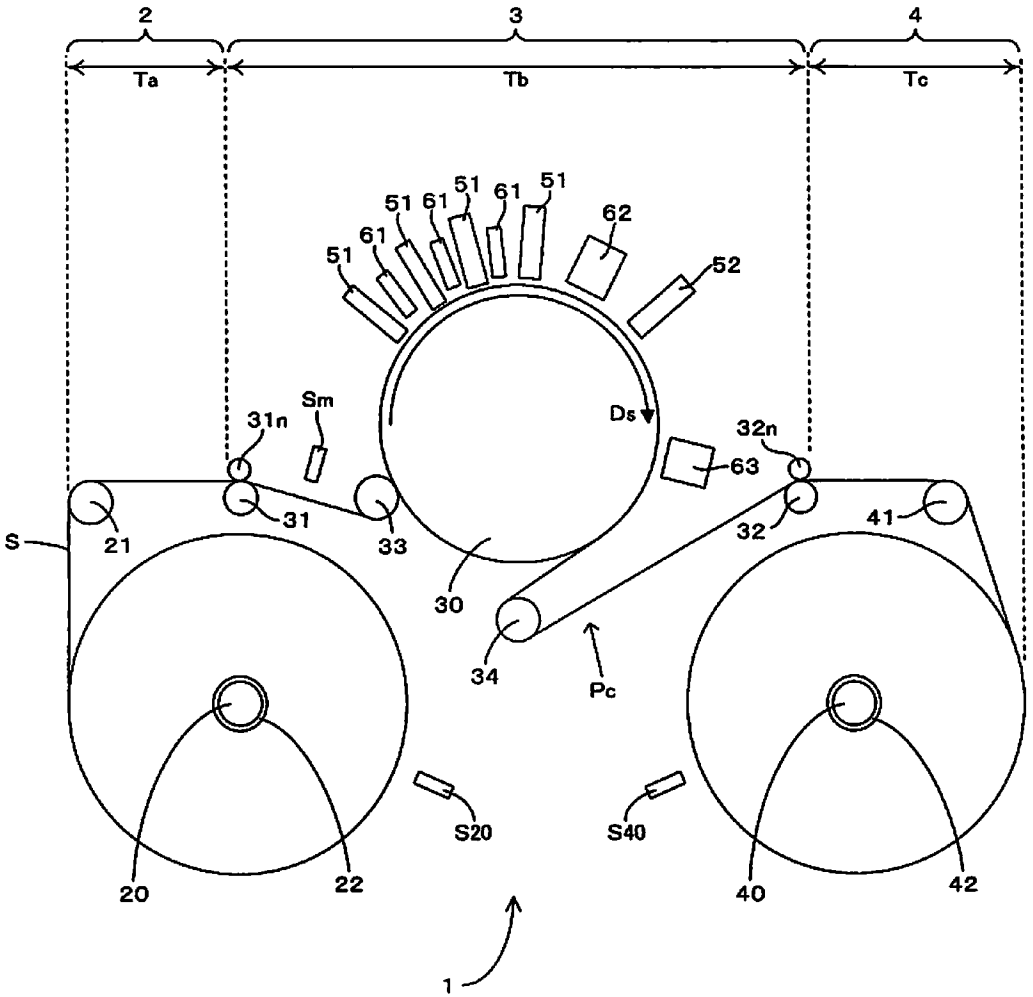
FIG. 1 is a drawing illustratively exemplifying an apparatus configuration provided to a printer with which the present invention can be put to practice.

FIG. 1 is a front view schematically illustrating an example of an apparatus configuration provided to a printer with which the present invention can be put to practice. As illustrated in FIG. 1, in a printer 1, a single sheet S (web) both ends of which have been wound up in the shape of a roll around a feed shaft 20 and a take-up shaft 40 is extended in a tensioned state along a conveyance path Pc, and the sheet S undergoes image recording while also being conveyed in a direction of conveyance Ds going from the feed shaft 20 toward the take-up shaft 40. The type of the sheet S is largely divided into paper-based and film-based. As specific examples, paper-based includes high-quality paper, cast paper, art paper, coated paper, and the like, while film-based includes synthetic paper, PET (polyethylene terephthalate), PP (polypropylene), and the like. As an overview, the printer 1 is provided with: a feed part 2 (feed-out region) for feeding the sheet S out from the feed shaft 20; a process part 3 (process region) for recording an image onto the sheet S fed out from the feed part 2; and a take-up part 4 (take-up region) for taking the sheet S, onto which an image was recorded at the process part 3, up into the take-up shaft 40. In the following description, whichever side of the two sides of the sheet S is the one on which the image is recorded is referred to as the "(front) surface", while the side opposite thereto is referred to as the "reverse surface".

The feed part 2 has the feed shaft 20, around which an end of the sheet S has been wound, as well as a driven roller 21 around which the sheet S having been drawn out from the feed shaft 20 is wound. The feed shaft 20 supports the end of the sheet S wound therearound in a state where the front surface of the sheet S faces outward. When the feed shaft 20 is rotated in the clockwise direction in FIG. 1, the sheet S having been wound around the feed shaft 20 is thereby made to pass via the driven roller 21 and fed out to the process part 3. The sheet S is wound up around the feed shaft 20 with a core tube 22 therebetween, the core tube 22 being detachable with respect to the feed shaft 20. As such, once the sheet S on the feed shaft 20 has been used up, then a new core tube 22 around which a roll of the sheet S has been wound can be mounted onto the feed shaft 20 to replace the sheet S of the feed shaft 20. Furthermore, a roll radius sensor S20 for detecting the roll radius of the sheet S wound into a roll on the feed shaft 20 is provided to the feed part 2.

The process part 3 is for performing processes as appropriate and recording an image onto the sheet S by using a variety of function parts 51, 52, 61, 62, 63 arranged along the outer peripheral surface of a rotating drum 30, while the sheet S having been fed out from the feed part 2 is supported on the rotating drum 30. At this process part 3, a front drive roller 31 and a rear drive roller 32 are provided to both sides of the rotating drum 30; the sheet S, which is conveyed from the front drive roller 31 to the rear drive roller 32, is supported on the rotating drum 30 and undergoes the recording of an image.

The front drive roller 31 has on the outer peripheral surface a plurality of minute projections formed by thermal spraying, and the sheet S having been fed out from the feed part 2 is wound around from the reverse surface side. When the front drive roller 31 is rotated in the clockwise direction in FIG. 1, the sheet S having been fed out from the feed part 2 is thereby conveyed downstream on the conveyance path. A nip roller 31*n* is provided to the front drive roller 31. The nip roller 31*n* is urged toward the front drive roller 31 side and in this state abuts against the front surface of the sheet S, and nips the sheet S with the front drive roller 31 on the other side. This ensures the force of friction between the front drive roller 31 and the sheet S, and makes it possible for the front drive roller 31 to reliably convey the sheet S.

The rotating drum 30 is a drum of cylindrical shape having a diameter of, for example, 400 mm, rotatably supported by a support mechanism (not shown) so as to be rotatable in both the direction of conveyance Ds and the reverse direction thereof, and winds the sheet S being conveyed from the front drive roller 31 to the rear drive roller 32 up from the back surface side. This rotating drum 30 is for supporting the sheet S from the reverse surface side while also being rotatingly driven in the direction of conveyance Ds of the sheet S, in response to the force of friction with the sheet S. Here, in the process part 3 there are provided driven rollers 33, 34 that loop the sheet S back at both sides of the part wound about the rotating drum 30. Of these, the driven roller 33 has the front surface of the sheet S wound around between the front drive roller 31 and the rotating drum 30 and loops the sheet S back. The driven roller 34, in turn, winds the front surface of the sheet S around between the rotating drum 30 and the rear drive roller 32 and loops the sheet S back. This manner of looping the sheet S back at the upstream and downstream sides in the direction of conveyance Ds relative to the rotating drum 30 makes it possible to ensure the length of the wind-up part of the sheet S for wind-up onto the rotating drum 30.

The rear drive roller 32 has on the outer peripheral surface a plurality of minute projections formed by thermal spraying, and the sheet S having been conveyed from the rotating drum 30 via the driven roller 34 is wound therearound from the reverse surface side. When the rear drive roller 32 is rotated in the clockwise direction in FIG. 1, the sheet S is thereby conveyed toward the take-up part 4. A nip roller 32*n* is provided to the rear drive roller 32. This nip roller 32*n* is urged toward the rear drive roller 32 side and in this state abuts against the front surface of the sheet S, and nips the sheet S with the rear drive roller 32 on the other side. This ensures the force of friction between the rear drive roller 32 and the sheet S, and makes it possible for the rear drive roller 32 to reliably convey the sheet S.

In this manner, the sheet S being conveyed from the front drive roller 31 to the rear drive roller 32 is supported on the outer peripheral surface of the rotating drum 30. Also, at the process part 3, in order to record a color image onto the front surface of the sheet S being supported on the rotating drum 30, a plurality of recording heads 51 corresponding to mutually different colors are provided. Specifically, four recording heads 51 corresponding to yellow, cyan, magenta, and black are lined up in the stated order of colors in the direction of conveyance Ds. Each of the recording heads 51 faces, spaced apart with a slight clearance, the front surface of the sheet S having been wound around the rotating drum 30, and ejects ink (coloring ink) of the corresponding color from nozzles in an inkjet format. When each of the recording heads 51 ejects ink onto the sheet S being conveyed in the direction of conveyance Ds, a color image is thereby formed on the front surface of the sheet S.

Here, the ink used is an ultraviolet (UV) ink that is cured by being irradiated with ultraviolet rays (light) (i.e., is a photocurable ink). Therefore, in the process part 3, UV irradiators 61, 62 (light irradiation parts) are provided in order to cure the ink and fix the ink to the sheet S. The execution of this curing of the ink is divided into two stages, which are temporary curing and main curing. A UV irradiator 61 for temporary curing is arranged in between each of the plurality of recording heads 51. In other words, the UV irradiators 61 are intended to irradiate with ultraviolet rays of low irradiation intensity and thereby cure the ink to such an extent that the ink wets and spreads sufficiently slower than when not irradiated with ultraviolet rays (that is, is intended to temporarily cure the ink), and is not intended to mainly cure the ink. The UV irradiator 62 for main curing, meanwhile, is provided to the downstream side in the direction of conveyance Ds relative to the plurality of recording heads 51. Namely, the UV irradiator 62 is intended to irradiate with ultraviolet rays of a greater irradiation intensity than the UV irradiators 61, and thereby cure the ink to such an extent that the wetting and spreading of the ink stops (i.e., is intended to mainly cure the ink).

In this manner, the color inks ejected onto the sheet S from the recording heads 51 on the upstream side of the direction of conveyance Ds are temporarily cured by the UV irradiators 61 arranged between each of the plurality of recording heads 51. As such, the ink that is ejected onto the sheet S by one recording head 51 is temporarily cured until reaching the recording head 51 that is adjacent to the one recording head 51 on the downstream side in the direction of conveyance Ds. The occurrence of color mixing, where color inks of different colors mix together, is thereby curbed. In this state where color mixing has been curbed, the plurality of recording heads 51 eject the color inks of mutually different colors and form the color image on the sheet S. Furthermore, the UV irradiator 62 for main curing is provided further downstream in the direction of conveyance Ds than the plurality of recording heads 51. Therefore, the color image that has been formed by the plurality of recording heads 51 is mainly cured by the UV irradiator 62 and fixed onto the sheet S.

A recording head 52 is also provided to the downstream side in the direction of conveyance Ds relative to the UV irradiator 62. This recording head 52 faces, spaced apart with a slight clearance, the front surface of the sheet S that is wound up around the rotating drum 30, and ejects a transparent UV ink onto the front surface of the sheet S in an inkjet format from a nozzle. In other words, the transparent ink is additionally ejected onto the color image formed by the recording heads 51 of the four different colors. This transparent ink is ejected onto the entire surface of the color image, and endows the color image with a glossy or matte texture. A UV irradiator 63 is also provided to the downstream side in the direction of conveyance Ds relative to the recording head 52. This UV irradiator 63 is intended to irradiate with intense ultraviolet rays and thereby mainly cure the transparent ink ejected by the recording head 52. This makes it possible to fix the transparent ink onto the front surface of the sheet S.

In this manner, at the process part 3, the sheet S wound around the outer peripheral part of the rotating drum 30 undergoes the ejecting and curing of the inks as appropriate, thus forming a color image coated with the transparent ink. The sheet S on which the color image has been formed is then conveyed toward the take-up part 4 by the rear drive roller 32.

In addition to the take-up shaft 40 around which an end of the sheet S is wound, the take-up part 4 also has a driven roller 41 around which the sheet S is wound from the reverse surface side between the take-up shaft 40 and the rear drive roller 32. The take-up shaft 40 supports one end of the sheet S taken up therearound in a state where the front surface of the sheet S is facing outward. In other words, when the take-up shaft 40 is rotated in the clockwise direction in FIG. 1, the sheet S, which has been conveyed from the rear drive roller 32, passes through the driven roller 41 and is taken up around the take-up shaft 40. Here, the sheet S is taken up around the take-up shaft 40 with a core tube 42 therebetween, the core tube 42 being detachable with respect to the take-up shaft 40. As such, when the sheet S taken up around the take-up shaft 40 is at capacity, then it becomes possible to remove the sheet S with the core tube 42. Also provided to the take-up part 4 is a roll radius sensor S40 for detecting the roll radius of the sheet S wound up in a roll on the take-up shaft 40.

In the printer 1, as shall be described below, the conveyance of the sheet S is controlled on the basis of a result from when marks M (eye marks) that have been formed in advance on the sheet S are detected. Therefore, a mark sensor Sm for detecting the marks M is arranged facing the front surface of the sheet S. In the example in FIG. 1, the mark sensor Sm is arranged between the front drive roller 31 and the driven roller 33, but the position of the mark sensor S is not limited thereto. The mark sensor Sm outputs a high-level signal when a detection value is a predetermined detection threshold value (first threshold value) or higher, but outputs a low-level signal of a lower level than the high level when the detection value is less than the detection threshold value. This mark sensor Sm outputs the low-level signal while the front surface of the sheet S (in other words, a base) is being detected, and outputs the high-level of a higher level than the low level while the marks M are being detected. As such, the mark sensor Sm outputs the low-level or high-level signal depending on the state of the front surface of the sheet S passing through the detection region thereof. Examples that could be used as such a mark sensor SM include an optical sensor that receives diffused light reflected while light is being emitted toward the sheet S, and outputs a signal of a level that corresponds to the amount of light received as a detection value.

Figure 2:
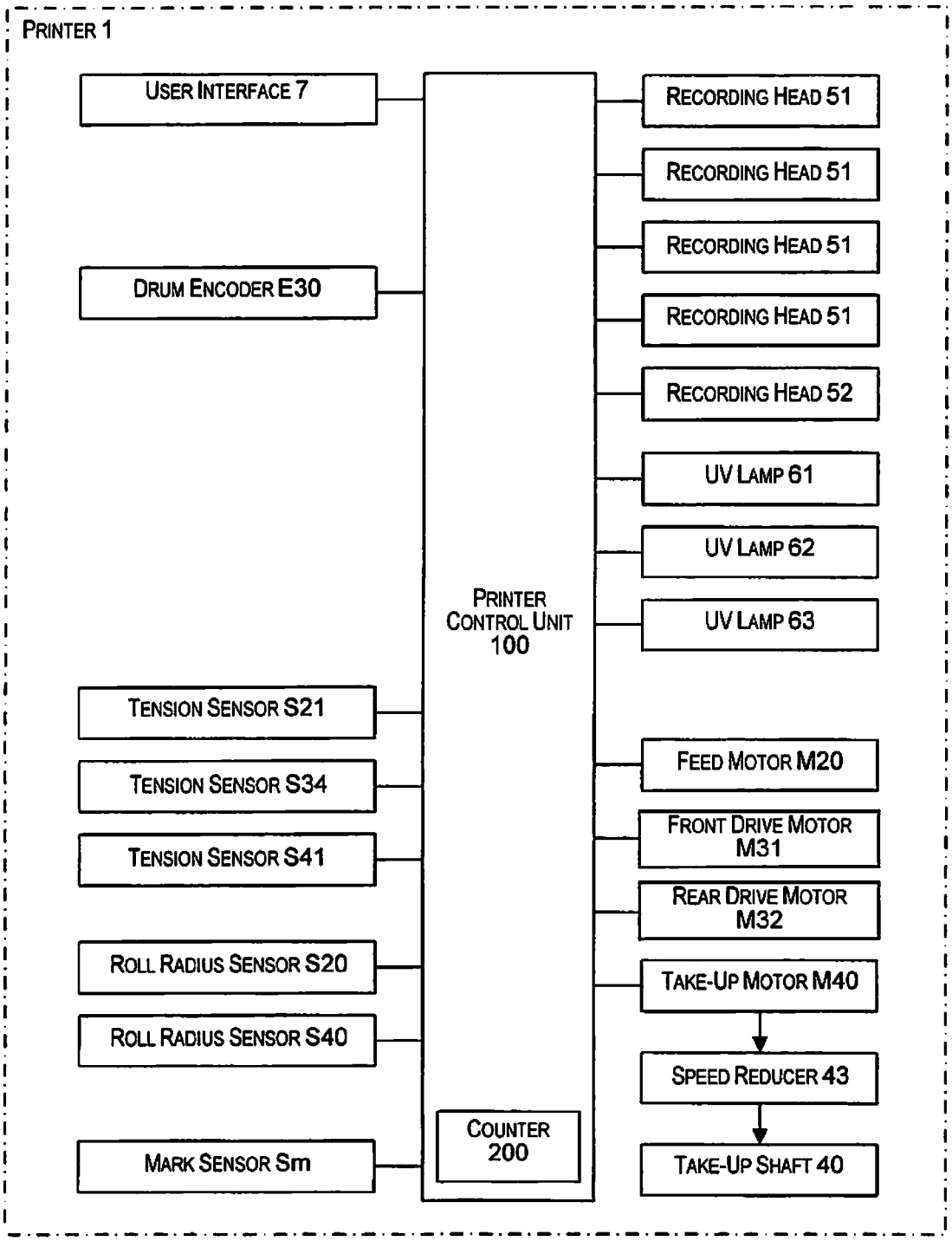
FIG. 2 is a drawing illustratively exemplifying an electrical configuration for controlling the printer illustrated in FIG. 1.

The foregoing is a summary of the apparatus configuration of the printer 1. The following description shall relate to the electrical configuration for controlling the printer 1. FIG. 2 is a block diagram schematically illustrating an example of the electrical configuration for controlling the printer illustrated in FIG. 1. In the printer 1, a printer control unit 100 for controlling each of the parts of the printer 1 is provided. Each of the apparatus parts for the recording heads, the UV irradiators, and the sheet conveyance system are controlled by the printer control unit 100. The details of the manner in which the printer control unit 100 controls each of the apparatus parts are as follows.

The printer control unit 100 controls the ink eject timing of each of the recording heads 51 for forming the color image, in accordance with the conveyance of the sheet S. More specifically, the control of the ink eject timing is executed on the basis of the output (detection value) of a drum encoder E30 that is attached to a rotating shaft of the rotating drum 30 and detects the position of rotation of the rotating drum 30. Namely, because the rotating drum 30 is rotatingly driven in association with the conveyance of the sheet S, it is possible to ascertain the position of conveyance of the sheet S when the output of the drum encoder E30 for detecting the position of rotation of the rotating drum 30 is consulted. In view thereof, the printer control unit 100 generates a print timing signal (pts) from the output of the drum encoder E30 and controls the ink eject timing of each of recording heads 51 on the basis of the pts signal, whereby the ink having been ejected by each of the recording heads 51 strikes a target position on the sheet S that is being conveyed, thus forming the color image.

The timing whereby the recording head 52 ejects the transparent ink, too, is controlled by the printer control unit 100 in a similar fashion on the basis of the output of the drum encoder E30. This makes it possible for the transparent ink to be accurately ejected onto the color image having been formed by the plurality of recording heads 51. Moreover, the irradiation light intensity and the timing for turning the UV irradiators 61, 62, 63 on and off are also controlled by the printer control unit 100.

The printer control unit 100 also governs a function for controlling the conveyance of the sheet S, as described in detail with reference to FIG. 1. Namely, among the members constituting the sheet conveyance system, a motor is respectively connected to the feed shaft 20, the front drive roller 31, the rear drive roller 32, and the take-up shaft 40. The printer control unit 100 controls the speed and torque of each of the motors while also causing the motors to rotate, thus controlling the conveyance of the sheet S. The details of this control of the conveyance of the sheet S are as follows.

The printer control unit 100 causes a feed motor M20 for driving the feed shaft 20 to rotate, and supplies the sheet S from the feed shaft 20 to the front drive roller 31. The printer control unit 100 herein controls the torque of the feed motor M20 to adjust the tension (feed-out tension Ta) of the sheet S from the feed shaft 20 to the front drive roller 31. Namely, a tension sensor S21 for detecting the magnitude of the feed-out tension Ta is mounted onto the driven roller 21 arranged between the feed shaft 20 and the front drive roller 31. The tension sensor S21 can be constituted of, for example, a load cell for detecting the magnitude of force received from the sheet S. The printer control unit 100 carries out a feedback control of the torque of the feed motor M20 on the basis of a result of detection (detection value) from the tension sensor S21, and thus adjusts the feed-out tension Ta of the sheet S.

The printer control unit 100 also rotates a front drive motor M31 for driving the front drive roller 31 and a rear drive motor M32 for driving the rear drive roller 32. The sheet S having been fed out from the feed part 2 is thereby passed through the process part 3. Herein, speed control is executed for the front drive motor M31, whereas torque control is executed for the rear drive motor M32. In other words, the printer control unit 100 adjusts the rotational speed of the front drive motor M31 to a constant speed, on the basis of an encoder output for the front drive motor M31. The sheet S is thereby conveyed at a constant speed by the front drive roller 31.

On the other hand, the printer control unit 100 controls the torque of the rear drive motor M32 and thus adjusts the tension (process tension Tb) of the sheet S from the front drive roller 31 to the rear drive roller 32. Namely, a tension sensor S34 for detecting the magnitude of the process tension Tb is attached to the driven roller 34 arranged between the rotating drum 30 and the rear drive roller 32. This tension sensor S34 can be constituted, for example, of a load cell for detecting the magnitude of force received from the sheet S. The printer control unit 100 also carries out feedback control of the torque of the rear drive motor M32 on the basis of a detection result (detection value) from the tension sensor S34, and thus adjusts the process tension Tb of the sheet S.

The printer control unit 100 rotates a take-up motor M40 for driving the take-up shaft 40 via a speed reducer 43, and causes the take-up shaft 40 to take up the sheet S being conveyed by the rear drive roller 32. Herein, the printer control unit 100 controls the torque of the take-up motor M40 and thus adjusts the tension (take-up tension Tc) of the sheet S from the rear drive roller 32 to the take-up shaft 40. Namely, a tension sensor S41 for detecting the take-up tension Tc is mounted onto the driven roller 41 arranged between the rear drive roller 32 and the take-up shaft 40. This tension sensor S41 can be constituted, for example, of a load cell for detecting the force received from the sheet S. The printer control unit 100 carries out a feedback control of the torque of the take-up motor M40 on the basis of a result of detection of the tension sensor S41, and thus adjusts the take-up tension Tc of the sheet S. In relation to this, the printer control unit 100 controls the take-up tension Tc while also modifying a target value of the take-up tension Tc in accordance with the detection value of the roll radius sensor S40, in order to execute a taper tension whereby the take-up tension Tc is reduced in response to an increase in the roll radius of the sheet S supported by the take-up shaft 40.

The printer 1 is equipped with a user interface 7, and a worker is able to input an instruction to the user interface or to look at the user interface 7 and check the state of the printer 1. In correspondence thereto, the printer control unit 100 either controls each of the parts of the printer 1 in accordance with an instruction inputted to the user interface 7, or causes the user interface 7 to display the state of the printer 1.

The printer control unit 100 counts the number of marks M that have been previously formed on the sheet S, in order to ascertain a position of conveyance of the sheet S. More specifically, the printer control unit 100 has a built-in counter 200. Every time the mark sensor Sm detects a mark M, a count value that is stored in the counter 200 is updated. With this configuration, consulting the count value of the counter 200 makes it possible to ascertain the position of conveyance of the sheet S. Next, a mark count executed by the printer control unit 100 shall be described in detail.

Figure 3:
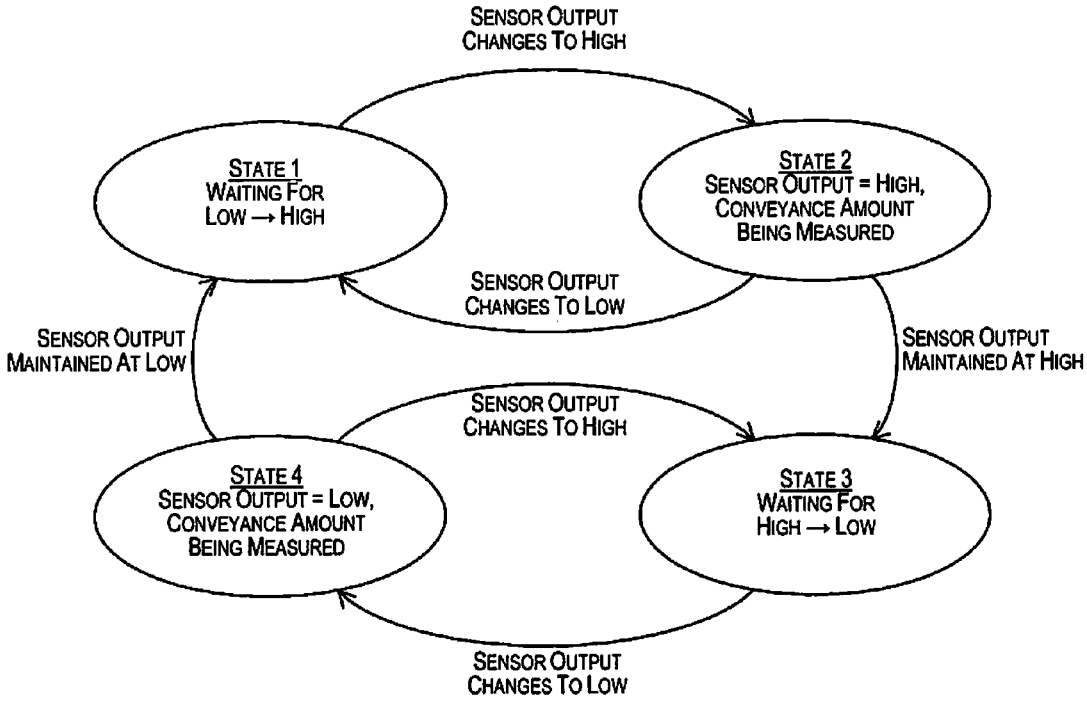
FIG. 3 is a state transition diagram illustratively exemplifying an operation in a mark count.
Figure 4:
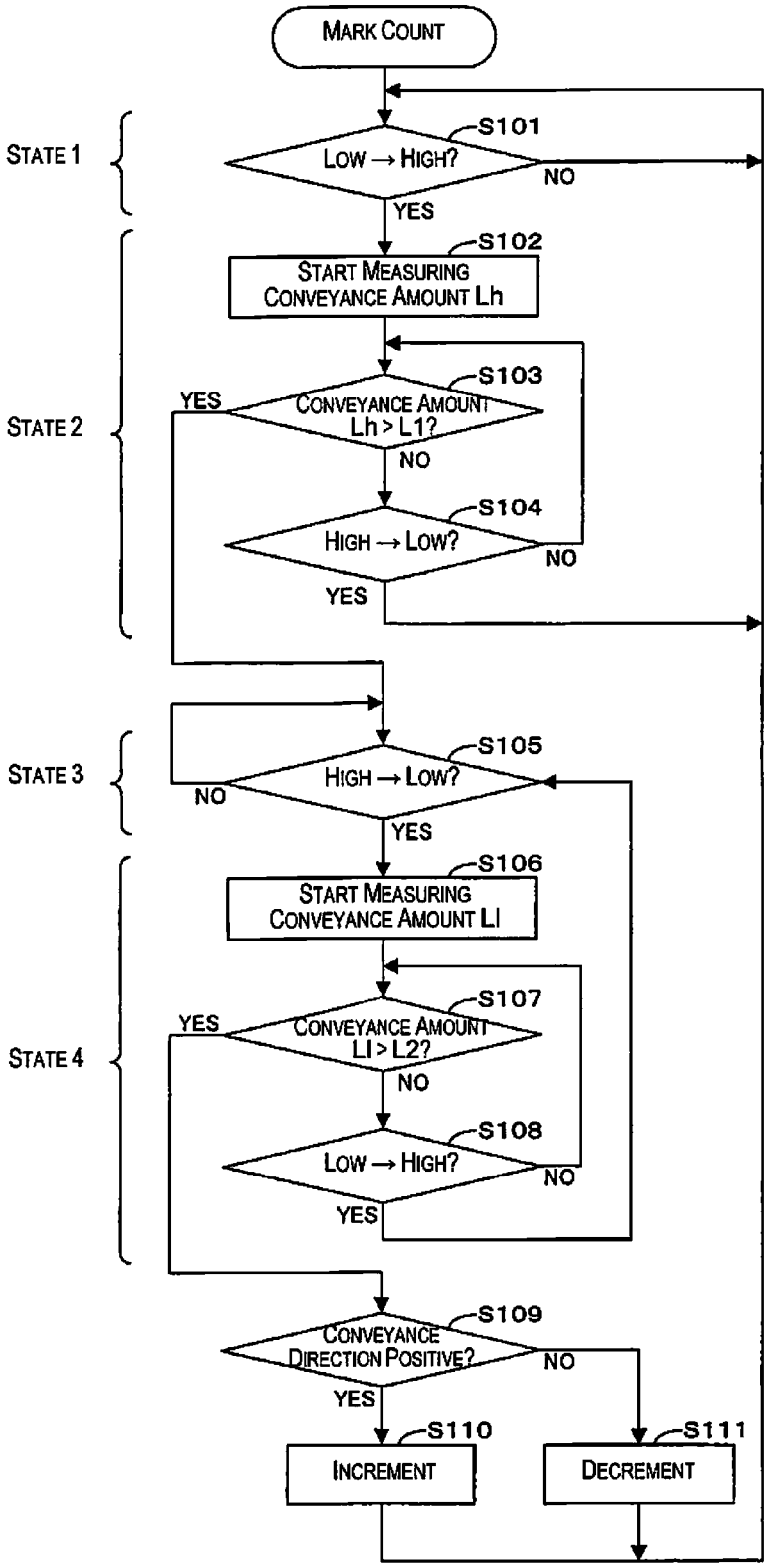
FIG. 4 is a flow chart illustratively exemplifying an operation in the mark count.
Figure 5:
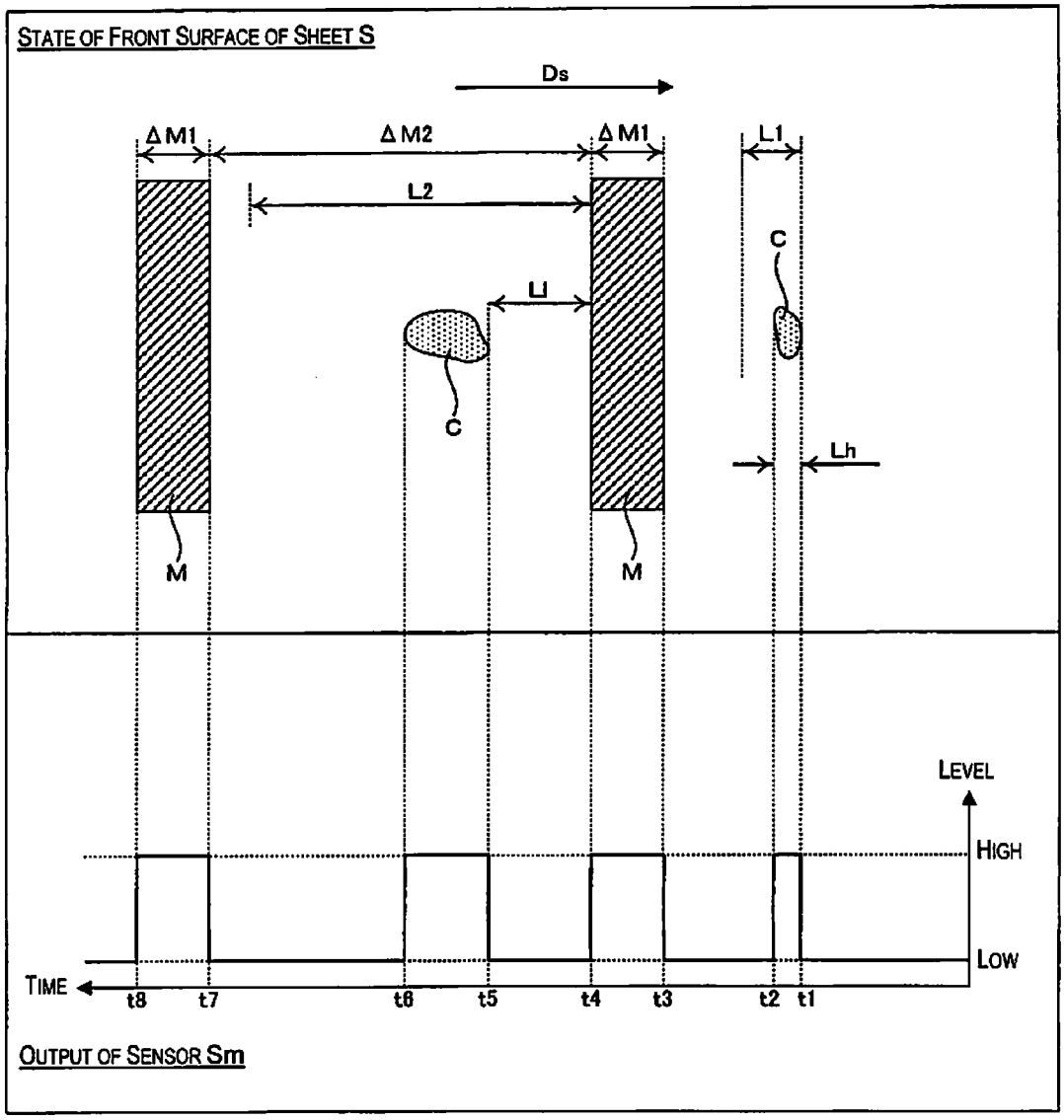
FIG. 5 is a drawing illustrating an example of an operation executed in the mark count in FIGS. 3 and 4.

FIG. 3 is a state transition diagram illustratively exemplifying an operation in the mark count. FIG. 4 is a flow chart illustratively exemplifying the operation in the mark count. FIG. 5 is a drawing schematically illustrating an example of an operation executed in the mark count in FIGS. 3 and 4. When the mark count is started, the printer control unit 100 takes a state 1 and waits for when the level of the output signal of the mark sensor Sm changes from low to high (step S101).

When the level of the output signal of the mark sensor Sm changes from low to high, then the printer control unit 100 transitions to a state 2. In the state 2, the printer control unit 100 starts measuring a conveyance amount Lh of the sheet S (step S102). More specifically, measurement of the conveyance amount Lh is executed by finding the angular displacement of the rotating drum 30, which rotates in association with the conveyance of the sheet S, from the output of the drum encoder E30. In this manner, in the state 2, the conveyance amount Lh of the sheet S after the level of the mark sensor Sm has changed to high is measured.

Next, in the state 2, a determination is made as to whether or not the conveyance amount Lh exceeds a first conveyance threshold value L1, until the level of the signal outputted by the mark sensor Sm changes from high to low (steps S103, 104). More specifically, first, in the step S103, a determination is made as to whether or not the conveyance amount Lh is greater than the first conveyance threshold value L1. In a case where the conveyance amount Lh is not greater than the first conveyance threshold value L1 ("NO" in step S103), then a determination is made as to whether or not the level of the output signal of the mark sensor Sm has changed from high to low (step S104). In a case where the level of the output signal of the mark sensor Sm is still high ("NO" in step S104), then the flow returns to the step S103.

In a case where the level of the output signal of the mark sensor Sm has changed from high to low despite the conveyance amount Lh not being greater than the first conveyance threshold value L1 (a case of "YES" in step S104), however, then the level change in the output signal of the mark sensor Sm in step S101 is determined not to be due to the detection of the mark M. Therefore, the printer control unit 100 transitions to the state 1, and again executes the step S101. Regarding this matter, the operation for times t1 to t2 in FIG. 5 shall be described by way of illustrative example.

In the example in FIG. 5, foreign matter C is detected at the time t1, and the level of the output signal of the mark sensor Sm changes from low to high; next, at the time t2 (>t1), the foreign matter C has finished passing through the detection region of the mark sensor Sm, and the level of the output signal of the mark sensor Sm changes from high to low. Then, the conveyance amount Lh of the sheet S in this period t1 to t2 is not greater than the first conveyance threshold value L1. Herein, the first conveyance threshold value L1 is set so as to be less than a width ΔM1 of the marks M in the direction of conveyance Ds; for example, the first conveyance threshold value L1 is set to be a value greater than 0 and 90% less than, 80% less than, 70% less than, 60% less than, 50% less than, 40% less than, 30% less than, 20% less than, or 10% less than the mark width ΔM1, and is stored in a built-in memory of the printer control unit 100. As such, the fact that the conveyance amount Lh is not greater than the first conveyance threshold value L1 means that the detected object in the period t1 to t2 where the conveyance of the conveyance amount Lh was performed can be determined not to be a mark M (in the example in FIG. 5, the detected object is the foreign matter C). Therefore, the printer control unit 100 returns to the state 1 without counting the high-level signal in the period t1 to t2.

In a case where, as a result of the loop of the steps S103 and S104 being executed, the conveyance level Lh exceeds the first conveyance threshold value L1 while the level of the output signal of the mark sensor Sm stays maintained at high (a case of "YES" in step S103), then the printer control unit 100 transitions to a state 3, and executes a step S105. This step is illustratively exemplified in the operation for the times t3 to t4 in FIG. 5. Namely, a mark M is detected at the time t1, and the level of the output signal of the mark sensor Sm changes from low to high. Here, the conveyance amount Lh corresponds to the mark width ΔM1, and is not less than the first conveyance threshold value L1, and therefore the printer control unit 100 determines as a result of the loop of the steps S103 and S104 that the detected object is the mark M, and transitions to the state 3. In the state 3, the printer control unit 100 waits for the mark M to pass through the detection region of the mark sensor Sm. More specifically, the printer control unit 100 waits for the level of the output signal of the mark sensor Sm to change from high to low (step S105).

When the level of the output signal of the mark sensor Sm changes from high to low, then the printer control unit 100 transitions to a state 4. In the state 4, the printer control unit 100 starts measuring a conveyance amount L1 of the sheet S (step S106). More specifically, measurement of the conveyance amount L1 is executed by finding the angular displacement of the rotating drum 30, which rotates in association with the conveyance of the sheet S, from the output of the drum encoder E30. In this manner, in the state 4, the conveyance amount L1 of the sheet S after the level of the mark sensor Sm has changed to low is measured.

Next, in the state 4, a determination is made as to whether or not the conveyance amount L1 exceeds a second conveyance threshold value L2, until the level of the signal outputted by the mark sensor Sm changes from low to high (steps S107, 108). More specifically, first, in the step S107, a determination is made as to whether or not the conveyance amount L1 is greater than the second conveyance threshold value L2. In a case where the conveyance amount L1 is not greater than the second conveyance threshold value L2 ("NO" in step S107), then a determination is made as to whether or not the level of the output signal of the mark sensor Sm has changed from low to high (step S108). In a case where the level of the output signal of the mark sensor Sm is still low ("NO" in step S108), then the flow returns to the step S107.

In a case where the level of the output signal of the mark sensor Sm has changed from low to high despite the conveyance amount L1 not being greater than the second conveyance threshold value L2 (a case of "YES" in step S108), however, then the level change in the output signal of the mark sensor Sm in step S108 is determined not to be due to the detection of the mark M. Therefore, the printer control unit 100 transitions to the state 3, and again executes the step S105. Regarding this matter, the operation for times t4 to t5 in FIG. 5 shall be described by way of illustrative example.

In the example in FIG. 5, at the time t4 the mark M is finished passing through the detection region of the mark sensor Sm, and the level of the output signal of the mark sensor Sm changes from high to low; next, at the time t5 (>t4), the foreign matter C is detected, and the level of the output signal of the mark sensor Sm changes from low to high. Then, the conveyance amount L1 of the sheet S in the period t4 to t5 is not greater than the second conveyance threshold value L2. Herein, the second conveyance threshold value L2 is set so as to be less than a width ΔM2 of the interval in the direction of conveyance Ds between two adjacent marks M; for example, the second conveyance threshold value L2 is set to be a value greater than 0 and 90% less than, 80% less than, 70% less than, 60% less than, 50% less than, 40% less than, 30% less than, 20% less than, or 10% less than the mark interval ΔM2, and is stored in a built-in memory of the printer control unit 100. As such, the fact that the conveyance amount L1 is not greater than the second conveyance threshold value L2 means that the conveyance amount L1 from the detection completion time t4 for the mark M until the time t5 is not less than the mark interval is less than the mark interval ΔM2 and the detected object at the time t5 can be determined not to be a mark M (in the example in FIG. 5, the detected object is the foreign matter C). Therefore, the printer control unit 100 returns to the state 3 without counting the high-level signal at the time t5.

In a case where, as a result of the loop of the steps S107 and S108 being executed, the conveyance level L1 exceeds the second conveyance threshold value L2 while the level of the output signal of the mark sensor Sm stays maintained at low (a case of "YES" in step S107), then the printer control unit 100 executes steps S109 to S111 and counts the high-level signals (the signals for the times t3 to t4 in the example in FIG. 5) corresponding to the marks M. More specifically, in the step S109, a determination is made as to whether or not the direction of conveyance of the sheet S is positive, on the basis of the output value of the drum encoder E30. Then, in a case where the direction of conveyance is positive (in other words, a first direction going from the feed shaft 20 toward the take-up shaft 40) (a case of "YES" in the step S109), then the printer control unit 100 increments the count value of the counter 200 in the step S110, and then returns to the state 1 and executes the step S101. In a case where the direction of conveyance is negative (in other words, a second direction going from the take-up shaft 40 toward the feed shaft 20) (a case of "NO" in the step S109), however, then the printer control unit 100 decrements the count value of the counter 200 in the step S111, and then returns to the state 1 and executes the step S101.

In the present embodiment configured as described above, the state of the front surface of the sheet S is detected using the mark sensor Sm (steps S101, S105). This mark sensor Sm outputs a high-level signal when the detection value is not less than the detection threshold value, but outputs a low-level signal when the detection value is less than the detection threshold value. When this mark sensor Sm is used, the marks can be detected on the basis of the output of high-level signals. The high-level signals, however, could be outputted not only when the marks M are detected correctly, but also when the foreign matter C or vibration of the sheet S occurs, as stated above. As such, in order to improve the accuracy of detection of the marks M, the question of whether or not to count a high-level signal (in other words, whether or not to handle a high-level signal as a signal that is indicative of a mark M) needs to be determined. With respect to this, in the present embodiment, the angular displacement (conveyance information) of the rotating drum 30, which is indicative of the state of conveyance of the sheet S, is acquired (steps S102, S106). Then, whether or not to count the high-level signals is decided on the basis of this conveyance information (steps S103 to S104, S107 to S108). In the present embodiment, the impact caused by the foreign matter C or vibration of the sheet S can be curbed, which contributes to improving the accuracy of detecting the marks M.

In the present embodiment, whether or not to count the high-level signals is decided on the basis of the result from when the conveyance amount Lh of the sheet S in the period during which the mark sensor Sm continues outputting high-level signals is found from the conveyance information (steps S103, S104). In other words, in, for example, a case where the conveyance amount Lh of the sheet S in a period where a high-level signal is continuously outputted is significantly different from the width of the marks M, then the high-level signal can be generally determined to be due to something other than the marks M, i.e., due to the foreign matter C or to vibration of the sheet S. In this manner, deciding whether or not to count the high-level signals on the basis of the conveyance amount Lh of the sheet S makes it possible to improve the accuracy of detection of the marks M.

More specifically, in the present embodiment, the decision is made not to count a high-level signal in a case where the conveyance amount Lh of the sheet S in the period where the mark sensor Sm continuously outputs the high-level signal is less than the first conveyance threshold value L1. With this configuration, comparing the conveyance amount Lh of the sheet S and the first conveyance threshold value L1 makes it possible to easily decide whether or not to count the high-level signal.

Also, in the present embodiment, whether or not to count the high-level signals is decided on the basis of the result from when the conveyance amount L1 of the sheet S in the period during which the mark sensor Sm continues outputting low-level signals, until when the mark sensor Sm starts outputting high-level signals, is found from the conveyance information. In this configuration, the determination is executed on the basis of the conveyance amount L1 of the sheet S in the period during which the mark sensor Sm continues outputting low-level signals, until when the mark sensor Sm starts outputting high-level signals. This means, in other words, that the period during which a low-level signal persists corresponds to the period after the previous high-level signal was outputted until when the subject high-level signal is outputted, and corresponds to the interval between high-level signals. As such, in, for example, a case such as where the conveyance amount L1 of the sheet S in the period during which a low-level signal persists is significantly different from the interval ΔM2 between adjacent marks M, then the subject high-level signal can be generally determined to be due to something other than the marks M, i.e., due to the foreign matter C or to vibration of the sheet S. In this manner, deciding whether or not to count the high-level signals on the basis of the conveyance amount L1 of the sheet S makes it possible to improve the accuracy of detection of the marks M.

More specifically, in the present embodiment, the decision is made not to count a high-level signal that the mark sensor Sm has started outputting in a case where the conveyance amount L1 of the sheet S in the period where the mark sensor Sm continuously outputs the low-level signal is less than the second conveyance threshold value L2. With this configuration, comparing the conveyance amount L1 of the sheet S and the second conveyance threshold value L2 makes it possible to easily decide whether or not to count the high-level signal.

In the present embodiment, the number of high-level signals for which the decision to count has been made is counted (steps S109 to S111). With this configuration, counting is executed every time a mark M is detected by the mark sensor Sm in association with the conveyance of the sheet S. As such, the conveyance amount, meaning the conveyance position, of the sheet S can be ascertained from the count value.

Here, in a case where direction of conveyance of the sheet S indicated by the output value (conveyance information) of the drum encoder E30 is the first direction (the direction going from the feed shaft 20 toward the take-up shaft 40), then the count value of the number of high-level signals that have been counted is incremented (steps S109, S110). In a case where the direction of conveyance of the sheet S indicated by the conveyance information is the second direction (the direction going from the take-up shaft 40 to the feed shaft 20) opposite to the first direction, however, then the count value is decremented (steps S109, S111). With this configuration, the count value is increased or decreased depending on the direction of conveyance of the sheet S, and therefore the count value can be made to be correctly reflective of the conveyance position of the sheet S.

Whether or not a configuration is one to which the invention has been applied can be executed, for example, by confirming whether or not the count value changes when the output signal of the mark sensor Sm is changed to the high level by when, inter alia, a detected object (mark) is made to pass through the detection region of the mark sensor Sm in a state where the sheet S has been stopped. Namely, it can be inferred that a configuration is one to which the invention has been applied if the count value does not change.

As stated above, in the first embodiment, the sheet S corresponds to one example of a "web" of the invention; step S101 or S105 corresponds to one example of a "first step" of the invention; step S102 or S106 corresponds to one example of a "second step" of the invention; steps S103 to S104 or S107 to S108 correspond to one example of a "third step" of the invention; the mark sensor Sm corresponds to one example of a "detector" of the invention; the printer control unit 100 corresponds to one example of a "control unit" of the invention; the detection threshold value corresponds to one example of a "first threshold value" of the invention; the first conveyance threshold value L1 corresponds to one example of a "second threshold value" of the invention; and the second conveyance threshold value L2 corresponds to one example of a "third threshold value" of the invention.

Figure 6:
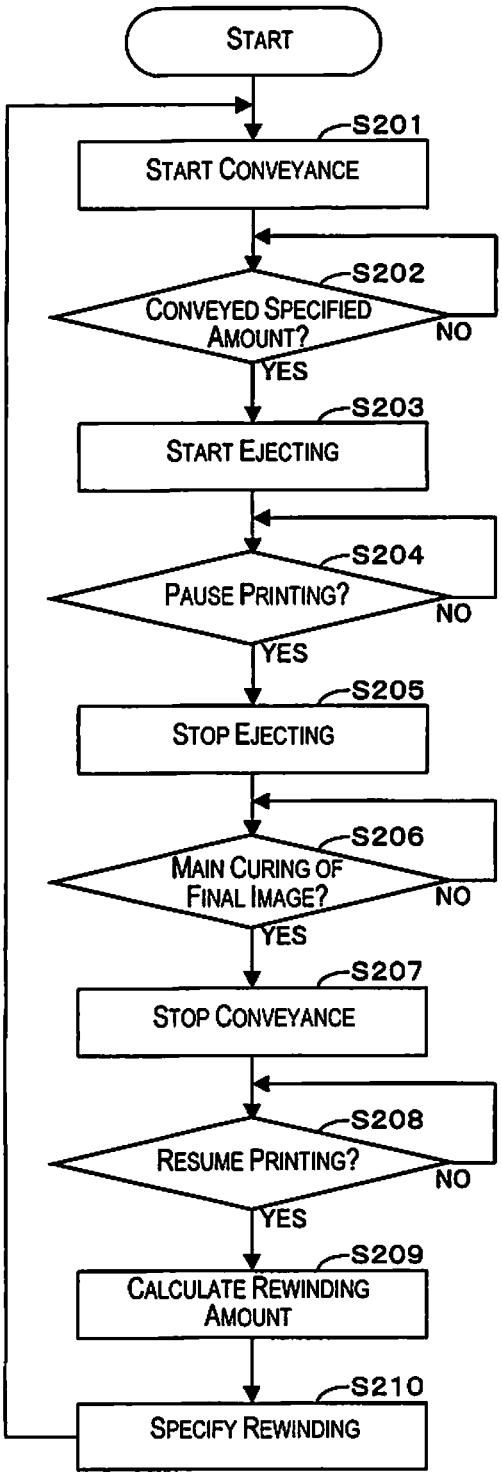
FIG. 6 is a flow chart illustratively exemplifying an application aspect of the mark count.

The invention is not to be limited to the embodiment described above; rather, a variety of different modifications can be added to what has been described above, provided that there is no departure from the spirit of the invention. For example, the embodiment above describes in particular a specific aspect for applying the mark count to the print operation in the printer 1, but a variety of applications aspects for the mark count can be considered. FIG. 6 is a flow chart illustrating an application aspect for the mark count.

Executing the flow chart in FIG. 6 enables the printer control unit 100 to execute printing as appropriate onto the front surface of the sheet S. In a step S201, the conveyance of the sheet S is started. At the same time, the above-described mark count is started, and continues thereafter. In a step S202, a determination is made as to whether or not a specified amount of conveyance has been completed, on the basis of the count value of the counter 200. In a case where the specified amount of conveyance has been completed (a case of "YES" in the step S202), then the ejecting of ink from the recording heads 51, 52 is started and the printing is started (step S203). The printing is continued until a determination is made to pause the printing in a step S204.

When a determination is made to pause the printing in the step S204 ("YES" in the step S204), then the ejecting of the ink from the recording heads 51, 52 is stopped (step S205). The conveyance of the sheet S and the irradiation with UV are continued for some time in order to mainly cure the ink that has attached to the sheet S. In a step S206, a determination is made as to whether or not the main curing of the image formed last on the sheet S (a final image) has been completed. When the main curing of the final image is complete ("YES" in the step S206), then the conveyance of the sheet S is stopped (step S207).

In a step S208, a determination is made as to whether or not to resume the printing. In a case where the printing is resumed (a case of "YES" in the step S208), then a rewinding amount S209 is calculated. This rewinding amount is an amount by which the sheet S is conveyed in the second direction (the direction going from the take-up shaft 40 toward the feed shaft 20) in order to resume the printing from a position adjacent to the final image in the previous printing. Next, in a step S210, rewinding of the sheet S commensurate with the rewinding amount is executed. At this time, the conveyance amount of the sheet S associated with the rewinding is controlled on the basis of the count value of the counter 200. When this rewinding is completed, then the flow returns to the step S201, and the subsequent flow is executed. The above is a specific application example of the mark count.

In the above embodiment, the marks were formed in advance, but the marks may also be formed in parallel with the image printing. In particular, in a case where the count of the marks M is being used in order to control the rewinding amount of the sheet S, then it suffices for the marks M to be formed by the recording heads 51 in parallel with the image printing and for the marks M to then be counted during the rewinding.

The embodiment above described in particular the relationship of magnitude between the first conveyance threshold value L1 and the second conveyance threshold value L2, but this relationship can take a variety of aspects. Namely, the second conveyance threshold value L2 may be greater than the first conveyance threshold value L1, or the first conveyance threshold value L1 and the second conveyance threshold value L2 may be equal, or the first conveyance threshold value L1 may be smaller than the second conveyance threshold value L2.

The relationship of magnitude between the mark width ΔM1 and the first conveyance threshold value L1 is also not limited to the example given above. As such, the first conveyance threshold value L1 may also be larger than the mark width ΔM1. In such a case, on the basis of the conveyance amount Lh being greater than the mark width AM1, the level change in the output signal of the mark sensor Sm in the step S101 could be determined not to be due to the detection of a mark M.

Also, in the embodiment above, the speed reducer 43 was provided to between the take-up motor M40 and the take-up shaft 40. However, the configuration may also be such that the torque is outputted from the take-up motor M40 to the take-up shaft 40 without an interposed speed reducer 43.

In the embodiment above, a reflection-type optical sensor was used as the mark sensor Sm, but there is no limitation thereto. For example, it would be possible to use an optical sensor that receives transmitted light that has been transmitted through the sheet S while light is being emitted toward the sheet S, and outputs a signal of a level corresponding to the amount of light received serving as a detection value.

Also, regarding the member supporting the sheet S being conveyed, there is no limitation to being one of a cylindrical shape as is the case with the rotating drum 30 described above. As such, it would also be possible to use a flat platen with which the sheet S is supported on a plane.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A mark detection method, comprising:

acquiring a signal that is outputted from a detector while a state of a web is being detected using the detector, the detector being configured to output a signal of a first level when a detection value is equal to or more than a first threshold value and output a signal of a second level different from the first level when the detection value is less than the first threshold value;

acquiring conveyance information indicative of a state of conveyance of the web; and determining whether or not to count the signal of the second level outputted by the detector based on the conveyance information.

2. The mark detection method as set forth in claim 1, wherein the determining includes determining whether or not to count the signal of the second level outputted by the detector based on a result from when a conveyance amount of the web in a period during which the detector continuously outputs the signal of the second level is evaluated from the conveyance information.

3. The mark detection method as set forth in claim 2, wherein the determining includes determining not to count the signal of the second level outputted by the detector in a case where the conveyance amount of the web in a period during which the detector continuously outputted the signal of the second level is less than a second threshold value.

4. The mark detection method as set forth in claim 2, wherein the determining includes determining whether or not to count the signal of the second level outputted by the detector based on a result from when the conveyance amount of the web in the period during which the detector continuously outputs the signal of the first level until when the detector starts outputting the signal of the second level is evaluated from the conveyance information.

5. The mark detection method as set forth in claim 4, the determining includes determining not to count the signal of the second level that the detector has started outputting in a case where the conveyance amount of the web in the period during which the detector has continuously outputted the signal of the first level is less than a third threshold value.

6. The mark detection method as set forth in claim 1, further comprising counting the number of signals of the second level for which counting has been decided in the determining.

7. The mark detection method as set forth in claim 6, wherein the counting of the number of signals of the second level includes incrementing a count value with which the number of signals of the second level is counted in a case where a direction of conveyance of the web as indicated by the conveyance information is a first direction, and decrementing the count value in a case where the direction of conveyance of the web as indicated by the conveyance information is a second direction opposite to the first direction.

8. A print apparatus, comprises:

a detector configured to output a signal of a first level when a detection value is equal to or more than a first threshold value and output a signal of a second level different from the first level when the detection value is less than the first threshold value; and a control unit configured to cause the detector to detect a state of a web, acquire a signal outputted from the detector, acquire conveyance information that is indicative of a state of conveyance of the web, and determine, based on the conveyance information, whether or not to count the signal of the second level outputted by the detector.

* * * * *